US007810296B1

(12) United States Patent
Turku

(10) Patent No.: US 7,810,296 B1
(45) Date of Patent: Oct. 12, 2010

(54) SHEATHING ASSEMBLY AND METHOD OF SHEATHING A ROOFING STRUCTURE

(76) Inventor: Blendi Turku, 195 SE. 2 St., Apt. lower, Dania Beach, FL (US) 33004

( * ) Notice: Subject to any disclaimer, the term of this patent is extended or adjusted under 35 U.S.C. 154(b) by 272 days.

(21) Appl. No.: 11/799,799

(22) Filed: May 3, 2007

(51) Int. Cl.
*E04D 1/00* (2006.01)

(52) U.S. Cl. ..... 52/518; 52/519; 52/520; 52/521; 52/528; 52/540

(58) Field of Classification Search ..... 52/518–521, 52/528, 540, 543, 22, 48, 57
See application file for complete search history.

(56) References Cited

U.S. PATENT DOCUMENTS

| | | | | |
|---|---|---|---|---|
| 1,418,377 | A * | 6/1922 | Jaynes | 52/420 |
| 3,546,843 | A * | 12/1970 | Luebs | 52/540 |
| RE27,574 | E * | 2/1973 | Kough et al. | 52/541 |
| 4,106,243 | A * | 8/1978 | Horn | 52/16 |
| 4,388,366 | A | 6/1983 | Rosato et al. | |
| 4,493,175 | A * | 1/1985 | Coppola, Jr. | 52/410 |
| 4,517,776 | A * | 5/1985 | Barker | 52/90.1 |
| 4,564,554 | A | 1/1986 | Mikuski | |
| 4,587,164 | A | 5/1986 | Freeman | |
| 4,670,071 | A * | 6/1987 | Cooper et al. | 156/71 |
| 4,707,961 | A * | 11/1987 | Nunley et al. | 52/408 |
| 4,783,942 | A * | 11/1988 | Nunley et al. | 52/309.1 |
| 4,852,314 | A | 8/1989 | Moore, Jr. | |
| 4,992,315 | A * | 2/1991 | Zickell et al. | 428/40.3 |
| 4,996,803 | A * | 3/1991 | Karrfalt et al. | 52/96 |
| 5,142,837 | A * | 9/1992 | Simpson et al. | 52/409 |
| 5,253,461 | A * | 10/1993 | Janoski et al. | 52/408 |
| 5,270,108 | A | 12/1993 | Savoy | |
| 5,473,847 | A | 12/1995 | Crookston | |
| 5,540,022 | A * | 7/1996 | Morris | 52/309.8 |
| 5,586,414 | A * | 12/1996 | Tawzer | 52/57 |
| 6,052,961 | A * | 4/2000 | Gibbs | 52/518 |
| 6,209,283 | B1 | 4/2001 | Folkersen | |
| 6,502,360 | B2 * | 1/2003 | Carr et al. | 52/408 |
| 6,588,172 | B2 | 7/2003 | Porter | |
| 6,701,685 | B2 * | 3/2004 | Rippey | 52/408 |
| 6,780,099 | B1 * | 8/2004 | Harper | 454/186 |
| 7,143,557 | B1 * | 12/2006 | Ayers, Jr. | 52/302.1 |
| 7,146,771 | B2 * | 12/2006 | Swann | 52/518 |
| 7,234,284 | B2 * | 6/2007 | Paradise et al. | 52/745.06 |
| 7,281,358 | B2 * | 10/2007 | Floyd | 52/518 |
| 2003/0126806 | A1 * | 7/2003 | Ellis | 52/95 |
| 2004/0109983 | A1 * | 6/2004 | Rotter et al. | 428/143 |
| 2005/0166533 | A1 * | 8/2005 | Strickland | 52/741.1 |
| 2006/0218869 | A1 * | 10/2006 | Ellis | 52/309.9 |
| 2007/0068109 | A1 * | 3/2007 | Swann | 52/518 |
| 2008/0036109 | A1 * | 2/2008 | Wrass | 264/46.7 |
| 2008/0243421 | A1 * | 10/2008 | Siegel et al. | 702/136 |
| 2009/0025316 | A1 * | 1/2009 | Coulton et al. | 52/199 |

* cited by examiner

*Primary Examiner*—Richard E Chilcot, Jr.
*Assistant Examiner*—Mark R Wendell
(74) *Attorney, Agent, or Firm*—Malloy & Malloy, P.A.

(57) ABSTRACT

A sheathing assembly and method of sheathing for a roofing structure including at least one lower layer comprising at least one, but more practically a plurality of panels. The lower layer may be disposed in at least partially overlying relation to a framing assembly of the roofing structure. The sheathing assembly may further include at least one upper layer comprising at least one or more panels. The sheathing assembly may also include a substantially flat central member or layer disposed in an at least partially clamped orientation between the lower layer and the upper layer.

22 Claims, 5 Drawing Sheets

SHEATHING ASSEMBLY AND METHOD OF SHEATHING A ROOFING STRUCTURE

BACKGROUND OF THE INVENTION

1. Field of the Invention

This invention relates to a sheathing assembly and method of sheathing a roofing structure. The sheathing assembly may be disposed in an overlying relation to the truss members, rafters, or other framing assembly of a roofing structure. Moreover, any outer roofing assembly may be disposed in an overlying relation to the sheathing assembly of the present invention. Furthermore, the sheathing assembly may comprise a lower layer, a central member, and an upper layer structured and disposed to strengthen a roofing structure to enable it to withstand high velocity winds, impacts, and severe weather conditions.

2. Description of the Related Art

Most houses, buildings, and other like structures comprise a roofing assembly having a plurality of covering members, such as shingles, tiles, or other similar objects. The covering members may commonly be secured to a layer of tar paper, roofing felt, or other like structure, which may typically be tin tabbed, nailed, hot mopped, or glued to a layer of wood directly underneath.

High velocity winds and other weather conditions typically present during hurricanes, tornadoes, and other like storms may break, damage, and/or destroy the roofing structures or assemblies on houses or buildings. Specifically, the wind may find its way underneath the shingles, tiles, or other exposed devices and either lift the covering members completely off of the roofing structure, or at least partially break or destroy them. Furthermore, loose objects such as lawn furniture, grills, or trees and shrubbery, as well as debris from neighboring structures may be tossed or projected through the air as a result of the high velocity winds and other like conditions. Such objects may impact or come into contact with the roofing structures and/or assemblies causing the covering members or other portions of the roof to crack, break, and/or otherwise become at least partially damaged.

Once the covering member(s), such as a shingle or ceramic tile becomes broken, damaged, or at least partially removed from the roofing structure, the other surrounding shingles and/or tiles may become more vulnerable to damage or destruction. In addition, the tar paper, roofing felt, or other at least partially water resistant material disposed directly adjacent to or beneath the exposed devices may be vulnerable to destruction or damage, especially as more shingles, tiles, and other like devices are damaged, destroyed, or removed. More in particular, as the shingles or tiles are damaged or removed from the roofing assembly, the tar paper, roofing felt, or other like structure disposed directly beneath is likely to be ripped, torn, or otherwise destroyed or damaged. As a result, the water resistance of the roofing structure may significantly depreciate. Thus, the remaining portions of the roofing structure will likely leak water from the rain or other weather conditions into the house and/or building.

As such, there is a current need in the art for a sheathing assembly for a roofing structure that may withstand high velocity winds and impacts that may result from projected objects. Furthermore, it would be beneficial if the proposed sheathing assembly is at least partially water resistant. The proposed sheathing assembly may be disposable in an overlying relation to a framing assembly, such as a plurality of trusses and/or rafters of the roofing structure. In addition, it would also be beneficial if the proposed sheathing assembly could be utilized with any roofing assembly, including shingles, tiles, tin roofs, wood, etc.

Moreover, the proposed sheathing assembly may include at least one central member disposed between a sturdy and/or durable lower layer and an upper layer. It would be beneficial if the central member of the proposed sheathing assembly was at least partially weather resistant.

Additionally, during the construction stages of a house, building, or other like structure, many projects must be completed in a certain strategic order. For example, the electrical wiring and/or completion of the internal walls of the building may not typically begin or progress until the roofing structure or assembly is installed. This is because the structure must be protected from the outer elements such as rain, snow, or other weather conditions.

As such, it would also be beneficial if the proposed sheathing assembly could be installed during early stages of the building construction. In such an instance, many projects dependent on the building being isolated from the outer elements may begin or continue prior the installation of the remaining portions of the roofing structure.

SUMMARY OF THE INVENTION

The present invention is related to a sheathing assembly for a roofing structure. The roofing structure may include at least one or more truss members, rafters, or other framing assembly. The truss members or rafters may preferably be disposed in a parallel, spaced apart relation, and function as part of the roof of a housing structure or other building. Furthermore, the roofing structure may include an outer roofing assembly. The outer roofing assembly may comprise at least one or more covering members, such as shingles, tiles, wood, tin, or any other structure or device that may be disposed on a roof. The outer roofing assembly may also comprise an underlayment disposed adjacent to, and preferably under the covering members. Moreover, an underlayment may commonly be referred to as a structure or device typically designed to protect the roof sheathing from moisture and water damage.

The outer roofing assembly may also include any structure, composition, or device which facilitates the covering members and/or underlayment to be attached or secured to the roof or roof sheathing. For example, the outer roofing assembly may include tar, glue, or other adhesives, as well as nails, tin tabs, screws, or other like structures.

The sheathing assembly of the present invention may include at least one lower layer disposed in an overlying relation to the truss members, rafters, or other framing assembly of the roofing structure. Additionally, the lower layer of the sheathing assembly may overlay an already installed paneling assembly, which may typically comprise a single layer of plywood or other like structures disposed in an overlying relation to the framing assembly. The lower layer of the present invention may preferably include panels, such as plywood or oriented strand board (OSB). Further, the panels of the lower layer may preferably be arranged in a staggered orientation and disposed in a perpendicular relation to the truss members, rafters, or other framing assembly of the roofing structure.

In at least one preferred embodiment of the present invention, the sheathing assembly may include at least one central member disposed in an overlying relation to the lower layer. The central member may include thirty (30) pound tar paper, however any strength, durability, and/or structure may be utilized to facilitate the intended practice of the present invention, such as, for example, roofing felt.

The central member may, but need not, be securely connected to the lower layer by securing devices, adhesives, or otherwise. Rather, the central member may be sandwiched between the lower layer and an upper layer. Similar to the lower layer, the upper layer may comprise a plurality of panels preferably disposed in a staggered orientation. The panels of the upper layer may comprise plywood, oriented strand board (OSB), or any other similar structures or devices. In addition, the upper layer may instead or additionally comprise cement board, such as Durock®. In such an embodiment, the covering members of the outer roofing assembly, such as ceramic tiles, may be directly secured or attached to the upper layer without the need for any intermediate underlayment.

Accordingly, it is contemplated that any outer roofing assembly may be disposed in an overlying relation to the sheathing assembly of the present invention, and more specifically, the upper layer thereof. The sheathing assembly of the present invention may facilitate a roofing structure that may withstand high velocity winds, impacts, and severe weather conditions.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
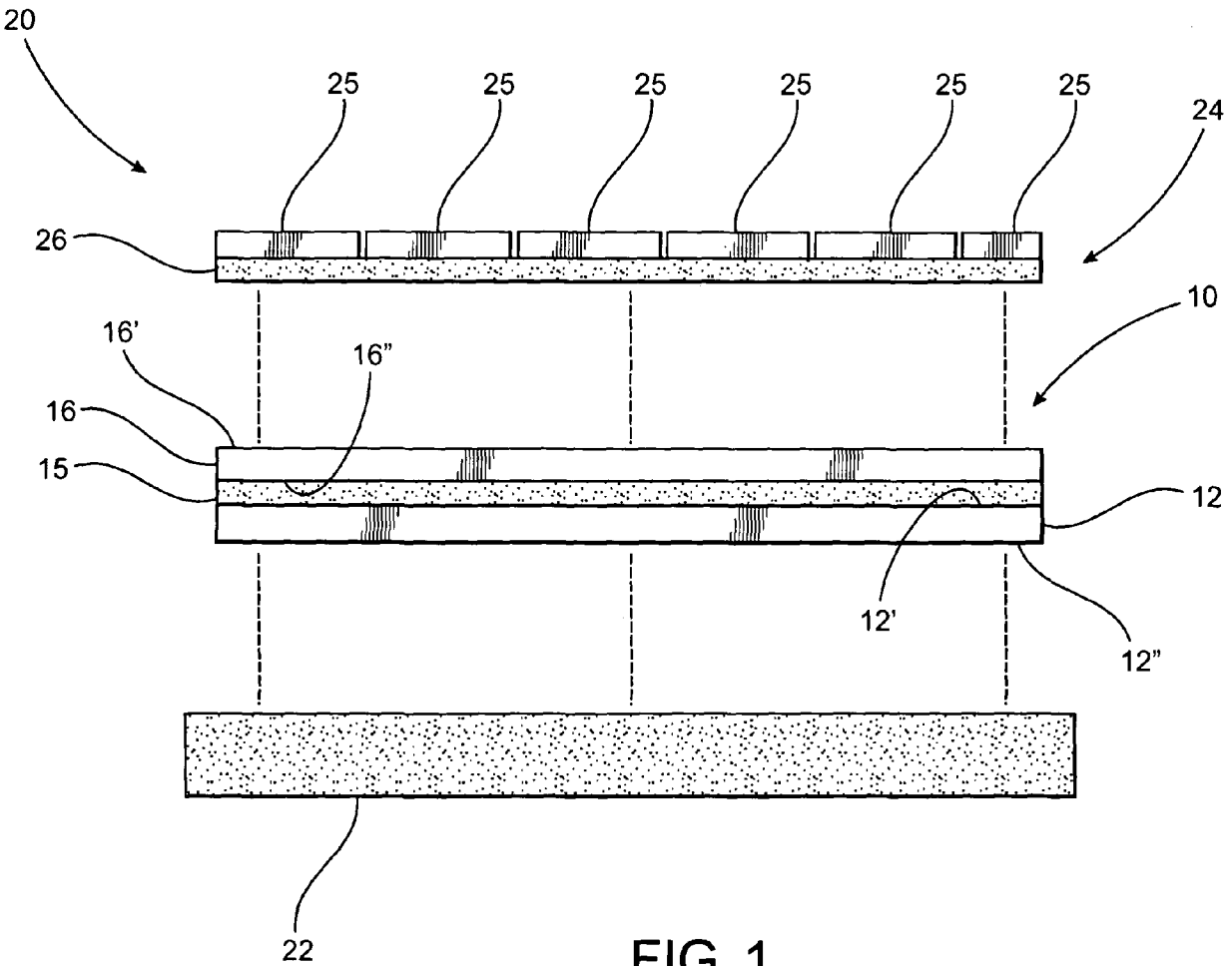
FIG. 1 is an exploded view of the roofing structure and at least one preferred embodiment of the sheathing assembly of the present invention.

As shown in the accompanying drawings, and with primary reference to FIG. 1, the present invention is directed to a sheathing assembly 10 for a roofing structure 20. Furthermore, as will be described in greater detail below, the present invention is also directed to a method of sheathing a roofing structure 20.

The roofing structure 20, as referred to herein, may include at least one, but more practically a plurality of truss members, rafters, or other framing assembly 22 preferably disposed in a parallel, spaced apart relation. In addition, the roofing structure 20 may further include an outer roofing assembly 24 which may comprise at least one or more covering members 25. The covering members 25 of the outer roofing assembly 24 may comprise any roofing material including, but not limited to, shingles, ceramic tiles, tin, wood, or any other material or device structured to be disposed on a roof and which is appropriate for use as a roof covering. Moreover, the outer roofing assembly 24 may comprise any device, mechanism, or structure to facilitate the attachment of the covering members 25 or to facilitate the intended benefits of the roofing structure 20. More in particular, the outer roofing assembly 24 may further include an underlayment 26, such as water resistant tar paper, roofing felt, or other like structures. As will be described below, the underlayment 26 may be disposed on and/or secured to the sheathing assembly 10 with tar (i.e., the use of which is conventionally referred to as "hot mopping"), glue, nails, tin tabs, and the like.

Further, the roofing structure 20 may be disposed on any building structure, such as, for example, a house, building, condominium, etc. Moreover, the roofing structure 20 of the present invention may preferably be a sloped or angled roof, such as, for example, a pitched roof or a gable roof. However, any roof structure, style, and/or orientation may be utilized, whether modern, new, or old.

Figure 2:
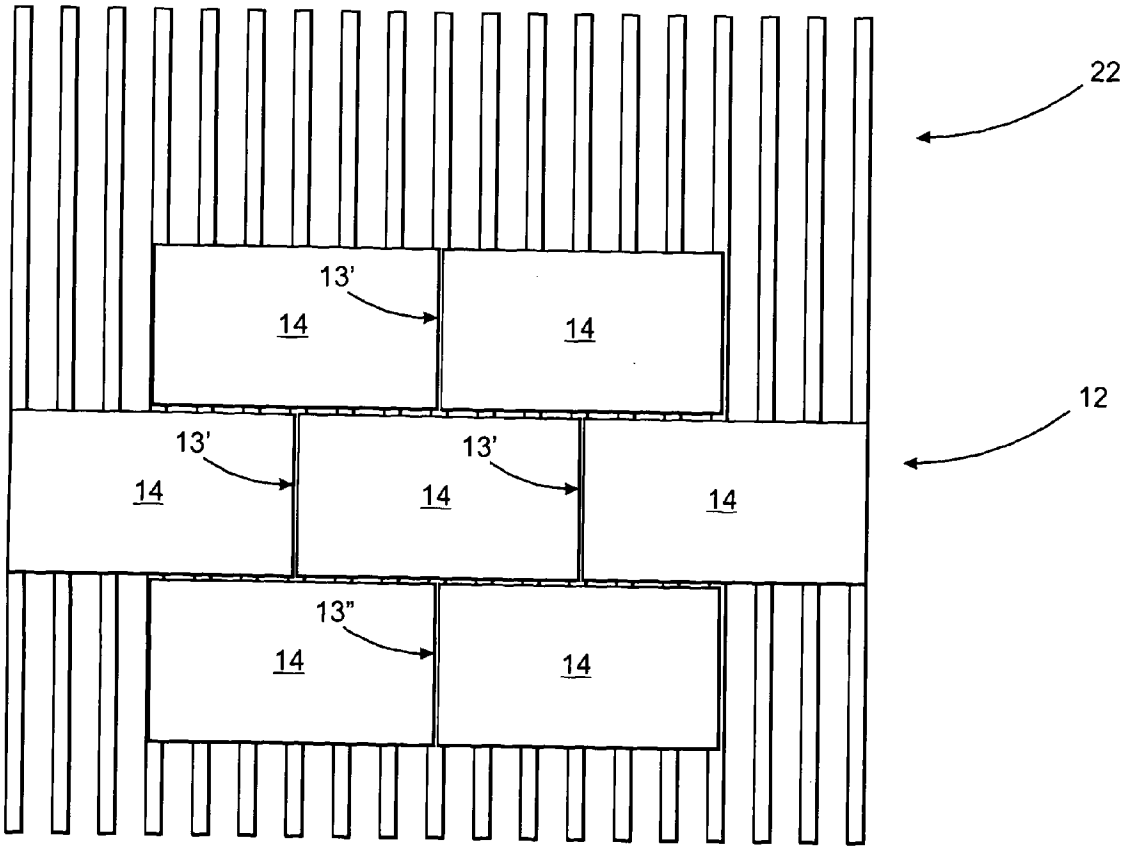
FIG. 2 is a schematic representation of a top view of a portion of the lower layer of one embodiment of the present invention.

As illustrated in FIG. 1, the sheathing assembly 10 of the present invention may be structured to be operatively disposed between the truss members, rafters, or other framing assembly 22 and the outer roofing assembly 24 of the roofing structure 20. Furthermore, in at least one embodiment of the present invention, the sheathing assembly 10 may include at least one lower layer 12 having a top surface 12' and a bottom surface 12". Additionally, as shown in FIG. 2, the lower layer 12 may comprise at least one, but preferably a plurality of panels 14. The panels 14 may comprise plywood and/or oriented strand board (OSB), but may include any other similarly structured device or panel which facilitates the practice of the sheathing assembly 10 of the present invention in the intended fashion.

Further, still referring to FIG. 2, the panels 14 in at least one preferred embodiment of the present invention may be adjacently disposed, and preferably aligned in a staggered and partially spaced apart relation. More in particular, two adjacently disposed panels 14 may meet at a junction 13, 13', or 13" at least partially defined by correspondingly disposed spaced apart peripheries of the adjacent panels 14. The spacing at the junctions 13, 13', and 13" may preferably allow the plurality of panels 14 some room for movement, thus partially increasing the structural integrity thereof. More in particular, the panels 14 may be walked on, especially during installation, which may cause the panels 14 to at least partially move side to side. In addition, weather conditions, such as high velocity wind gusts, may force the panels 14 to move at least partially around.

Figure 3:
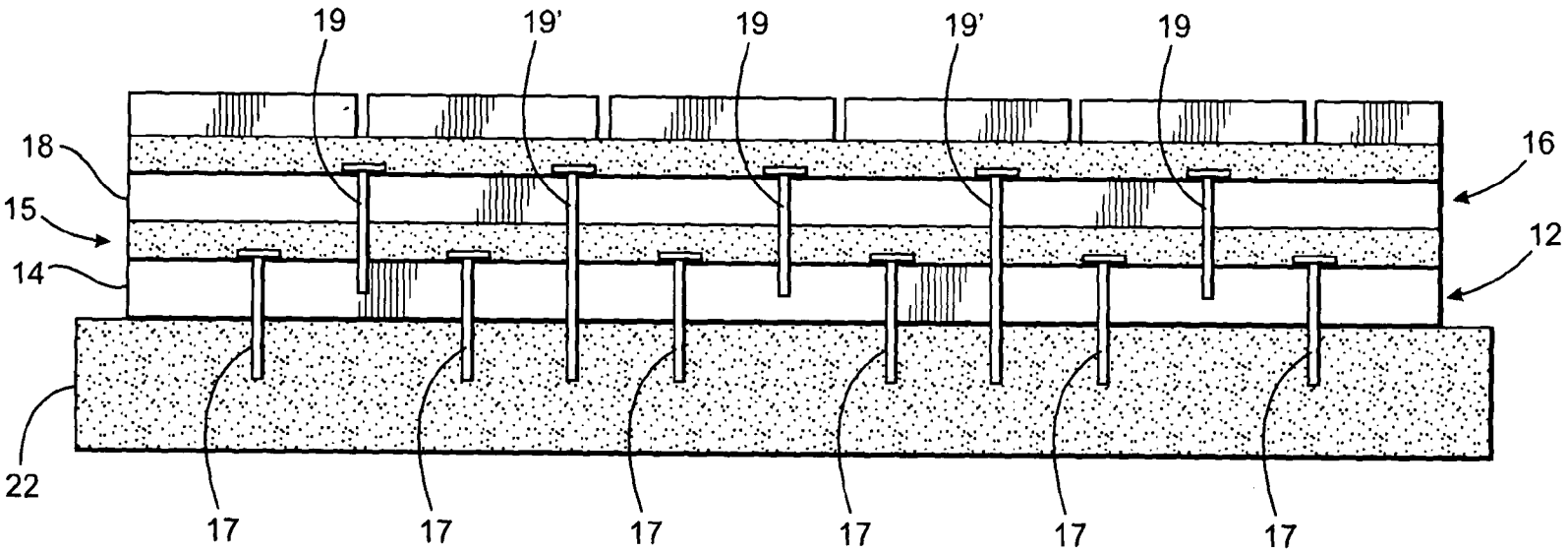
FIG. 3 is a schematic representation of an elevational view of at least one embodiment of the present invention.

Moreover, in at least one preferred embodiment of the present invention, the panels 14 of the lower layer 12 may preferably be disposed in a perpendicular, yet overlying relation to the truss members, rafters, or other framing assembly 22 of the roofing structure 20. In addition, as shown in FIG. 3, the panels 14 of the lower layer 12 may be secured and/or connected to the framing assembly 22 utilizing at least one, but more practically a plurality of securing devices 17. The securing devices 17, such as for example, nails, may be structured and disposed to penetrate and pass completely through the panels 14 and come into securing contact with the framing assembly 22 of the roofing structure 20. In addition, however, the lower layer 12 of the present invention may be disposed in an overlying relation to any structure, such as a paneling assembly that may already be installed. In such an instance, the lower layer 12 may be secured to the paneling assembly and/or the framing assembly 22 of the roofing structure 20.

Figure 4:
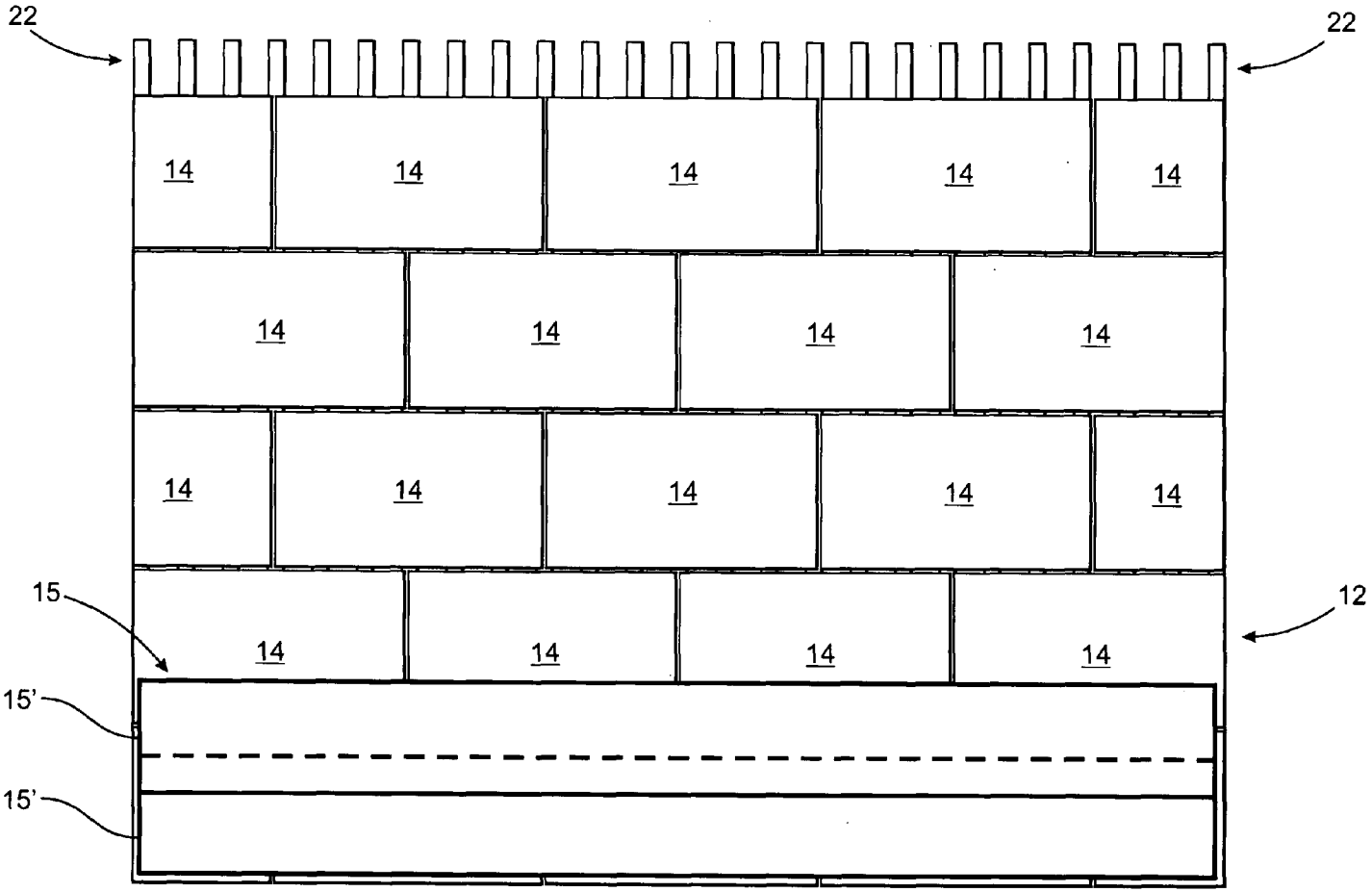
FIG. 4 is a schematic representation of a top view of the lower layer and portions of the central member of at least one preferred embodiment of the present invention.

Referring again to FIG. 1, and as also shown in FIG. 4, in at least one preferred embodiment of the present invention, the sheathing assembly 10 may further include a central member 15 disposed in at least partially overlying relation to the lower layer 12. For illustrative purposes only, FIG. 4 shows a partially installed central member 15 in overlying relation to the lower layer 12. The central member 15 may preferably include a continuously thin, flat structure including but not limited to at least one, but more practically a plurality of sheets of tar paper or roofing felt 15'. However, the central member 15 may comprise any similar device or structure which is preferably at least partially water resistant. As shown in FIG. 4, each individual sheet 15' of the central member 15 may have its peripheral portion overlap corresponding peripheral portions of adjacent sheets 15', for example by three (3) to six (6) inches. However any amount of overlapping, including no overlapping may be implemented. As further represented in FIG. 4, when disposed in such a partially overlapping relation to one another the remaining non-overlapping portions of the plurality of sheets 15' are disposed in substantially coplanar relation to one another.

Further, the use of nails, tin tabs, or other like structures or devices to secure or connect the central member 15 to the lower layer 12, or otherwise in place, may, but need not be incorporated. Moreover, hot tar, the use of which is commonly known as "hot mopping", or other similar structures or adhesives, such as glue, are preferably not utilized to adhere or otherwise secure or connect the central member 15 to the lower layer 12. More in particular, the utilization of hot tar, glue, or other adhesive substances spread or applied substantially to the underside, or other portions of the central member 15 may cause the central member 15 to tear, rip, or otherwise deform in the presence of movement or adjustment. As will be described below, the central member 15 of at least one preferred embodiment of the present invention may be secured in a clamped or otherwise sandwiched engagement between the lower layer 12 and an upper layer 16.

Similar to the lower layer 12, the upper layer 16 of at least one preferred embodiment of the present invention may include at least one, but more practically, a plurality of panels 18. The upper layer 16 may include a top surface 16' and a bottom surface 16". Moreover, the panels 18 of the upper layer 16 may include plywood, oriented strand board (OSB), or any other structure which facilitates the practice of the present invention in the intended fashion. Furthermore, in at least one embodiment of the present invention, preferably where the covering members 25 of the roofing structure 20 comprises ceramic tile or any other similar structure, the panels 18 of the upper layer 16 may include a more durable structure, including but not limited to, cement board, such as Durock®. More in particular, the panels 18 of the upper layer 16 may include a layered composition, including layers of fiberglass, cement, and/or any other similar structures or devices which facilitate the intended practice of the present invention.

In at least one embodiment of the present invention, similar to the panels 14 of the lower layer 12, the panels 18 of the upper layer 16 may be adjacently disposed, and preferably aligned in a staggered and partially spaced apart relation. Moreover, the upper layer 16 may be structured and disposed to at least partially overlay the central member 15. Accordingly, the central member 15 may be disposed in at least partially clamped or otherwise sandwiched orientation between the lower layer 12 and the upper layer 16.

Additionally, in at least one preferred embodiment of the present invention, the sheathing assembly 10 may further include securing devices 19 and 19' structured and disposed to penetrate completely through the upper layer 16 and/or the panels 18 thereof. The securing devices 19 may be structured to penetrate the central member 15 completely therethrough and come into securing contact with the lower layer 12, and/or the panels 14 thereof. Further, in yet another embodiment, the securing devices 19' may be structured and disposed to penetrate the lower layer 12, and come into securing or engaging contact with the truss members, rafters, or other framing assembly 22.

Accordingly, once the sheathing assembly 10 of the present invention has been installed in an overlying relation to the framing assembly 22 of the respective housing structure or building, the internal components of the house disposed beneath the sheathing assembly 10 will preferably be protected by the natural elements, such as high velocity winds, rain and snow. As such, installing the walls, plumbing, wiring, and other like projects may be completed and/or progressed before the remaining portions of the roofing structure 20 are constructed or assembled, such as the outer roofing assembly 24.

Figure 5:
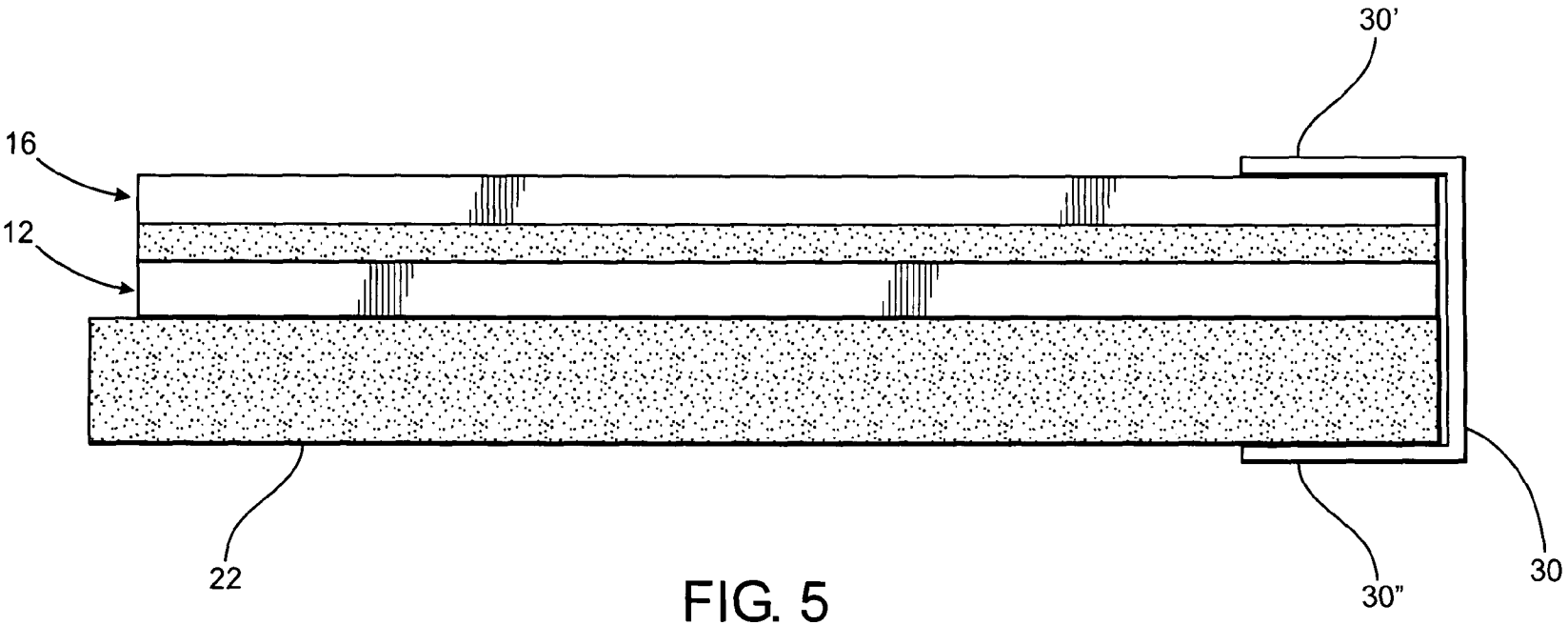
FIG. 5 is a schematic representation of a side elevational view of another embodiment of the present invention.

In at least one embodiment of the present invention, the sheathing assembly 10 may further include a bracket 30 preferably have a U-shaped configuration as represented in FIG. 5. The bracket 30 may comprise metal, plastic, wood, or any other structure, preferably of sufficient durability, which facilitates the intended practice of the invention. Moreover, the bracket 30 may be disposed in a clamping engagement with the upper layer 16 and at least one truss member, rafter, or other framing assembly 22 of the roofing structure 20. In at least one embodiment of the present invention, the U-shaped configuration of the bracket 30 may include a first portion 30' disposed to overlay at least ten (10) inches on the top surface 16' of the upper layer 16 and a second portion 30" disposed to overlay at least ten (10) inches on the bottom surface of the framing assembly 22. However, any length of overlapping may be implemented.

By clamping and/or at least partially attaching the sheathing assembly 10 to the truss members, rafters, or other framing assembly 22, the bracket 30 may be structured and disposed to facilitate and/or increase the durability and strength of the roofing structure 20. As such, the sheathing assembly 10 may be securely held in place, and thus, may be structured to withstand high velocity, hurricane force winds, including any impacts and/or other weather conditions.

Further, the upper layer 16 of at least one preferred embodiment of the present invention may be structured to be disposable in an underlying relation to the outer roofing assembly 24 of the roofing structure 20. More in particular, once the sheathing assembly 10 of the present invention is installed in an overlying relation to the framing assembly 22, then any contemplated outer roofing assembly 24 may be disposed in an overlying relation thereto. For example, an underlayment 26, such as tar paper, roofing felt, or any other similarly structured device may be disposed in overlying relation to the upper layer 16 of the sheathing assembly 10 of the present invention. The underlayment 26 may be "hot mopped", glued, nailed, tin tabbed, or otherwise adhered or secured to the upper layer 16. Furthermore, at least one or more covering members 25 may be disposed in an overlying relation to the underlayment 26, or directly to the upper layer 16 of the sheathing assembly 10. As previously described above, the covering members 25 may include shingles, ceramic tile, tin, wood, or any other device disposable on the roof of a housing structure or building. However, as previously mentioned herein, the outer roofing assembly 24 need not include an underlayment 26, particularly in the embodiment wherein the upper layer 16 comprises DuRock® or other like structure. In such an embodiment, the covering member(s) 25 may be secured directly to the upper layer 16 of the present invention.

The present invention further includes a method of sheathing a roofing structure 20. In at least one preferred embodiment, the method may include providing a lower layer 12 disposed in at least partially overlying relation to the framing assembly 22 of the roofing structure 20. The method of sheathing a roofing structure 20 of the present invention may further include securing the lower layer 12 to the truss member(s), rafter(s), or other framing assembly 22. Securing the lower layer 12 to the framing assembly 22 may comprise the use of a plurality of securing devices 17 structured and disposed to penetrate the lower layer 12 completely therethrough. Further, the securing devices 17 may come into securing and/or engaging contact with the framing assembly 22.

In at least one preferred embodiment, the method of sheathing a roofing structure 20 may include providing a central member 15 disposed in at least partially overlying relation to the lower layer 12. As above, the central member 15 may preferably comprise an at least partially water resistant structure, such as tar paper and/or roofing felt.

The method of sheathing a roofing structure 20 may further comprise providing an upper layer 16 disposed in at least partially overlying relation to the central member 15. As such, the central member 15 may be disposed in a clamping engagement with, or sandwiched between the lower layer 12 and the upper layer 16. Further, the method of sheathing may further include securing upper layer 16 to the lower layer 12 by utilizing a plurality of securing devices 19 and 19'.

In addition, in at least one embodiment of the present invention, the method of sheathing a roofing structure 20 may further comprise providing a bracket 30 disposed in at least partially clamping relation to the upper layer 16 and the truss member(s), rafter(s), or other framing assembly 22. The bracket 30 may comprise any structure or material, preferably metallic in nature. However, the bracket 30 may comprise plastic, wood, or any other durable material.

Once constructed, assembled, and installed, the sheathing assembly 10 and method of sheathing of the present invention may facilitate or provide a roofing structure 20 at least partially resistant to high velocity winds and impacts, such as those conditions commonly experienced during hurricanes and other like storms. More in particular, although high wind(s) and/or impact(s) exerted on the roofing structure 20 may destroy, remove, or otherwise deform the outer roofing assembly 24, the structural integrity of the sheathing assembly 10 of the present invention is likely to remain intact. Further, as a result of the at least partially water resistant central member 15 disposed in a clamped orientation between the upper layer 16 and the lower layer 12, the living and/or storage quarters of the building will likely remain protected from the outer elements.

Once the covering members 25 are damaged or removed, for example, from high velocity winds or impacts resulting therefrom, the unprotected underlayment 26 is also likely to be damaged. Further, because of the presence of tar, glue, or other adhesives commonly used to secure the underlayment 26, the underlayment 26 is vulnerable to tearing and/or ripping. However, although the underlayment 26 may tear and/or rip, the durable, water and wind resistant sheathing assembly 10 of the present invention is structured to stay intact. In the absence of the sheathing assembly 10 of the present invention, however, subsequent to destruction of the covering members 25 and/or the underlayment 26, the housing structure will likely leak water, and be more susceptible to internal water damage.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An assembly for a roofing structure, comprising:

at least one lower layer having a top surface and a bottom surface, wherein said lower layer comprises a plurality of laterally arranged panels disposed in disconnected, spaced relation to one another, said plurality of panels of said lower layer collectively disposed in overlying relation to a framing assembly of the roofing structure, at least one upper layer having a top surface and a bottom surface, wherein said upper layer comprises a plurality of laterally arranged panels disposed in disconnected, spaced relation to one another, said upper layer being disposable in an underlying relation to an outer roofing assembly of the roofing structure, a central member comprising a plurality of sheets disposed in confronting relation to and between said top surface of said lower layer and said bottom surface of said upper layer, said plurality of sheets collectively and partially disposed in substantially coplanar relation to one another and in sandwiched relation between said plurality of panels of said lower layer and said plurality of panels of said upper layer, and at least one U-shaped bracket disposed in a clamping engagement with said upper layer and the framing assembly of the roofing structure.

2. An assembly for a roofing structure as recited in claim 1 wherein said plurality of sheets are formed of a flexible, water resistant material.

3. An assembly for a roofing structure as recited in claim 1 further comprising a plurality of securing devices structured and disposed to secure said lower layer to the framing assembly of the roofing structure.

4. An assembly for a roofing structure as recited in claim 1 further comprising a plurality of securing devices structured and disposed to secure said upper layer to said lower layer.

5. An assembly for a roofing structure as recited in claim 4 wherein said plurality of securing devices are structured and disposed to penetrate said central member.

6. An assembly for a roofing structure as recited in claim 4 wherein said securing devices are structured and disposed to at least partially penetrate the framing assembly of the roofing structure.

7. An assembly for a roofing structure as recited in claim 1 wherein said disconnected, spaced relation of said plurality of panels of said lower layer is at least partially defined by correspondingly disposed peripheries of adjacent ones of each of said plurality of panels of said lower layer being disposed in spaced relation to one another.

8. An assembly for a roofing structure, comprising:

at least one lower layer having a top surface and a bottom surface and including a plurality of panels each disposed in disconnected, spaced relation to next laterally adjacent ones of said plurality of panels of said lower layer, said lower layer being disposed in an at least partially overlying relation to a framing assembly of the roofing structure, an upper layer having a top surface and a bottom surface, and including a plurality of panels each disposed in disconnected, spaced relation to next laterally adjacent ones of said plurality of panels of said upper layer, a central member comprising a plurality of sheets disposed between and in confronting relation to said top surface of said lower layer and said bottom surface of said upper layer, each of said plurality of sheets being at least partially formed of a flexible, water resistant material, and a bracket comprising a U-shaped configuration and including a first portion disposed in clamping engagement with said upper layer and a second portion disposed in clamping engagement with the framing assembly of the roofing structure.

9. An assembly for a roofing structure as recited in claim 8 wherein at least a portion of each of said plurality of sheets of said central member are disposed in substantially coplanar relation to one another and collectively comprise a substantially flat configuration.

10. An assembly for a roofing structure as recited in claim 8 further comprising a plurality of securing devices structured and disposed to connect said lower layer to the framing assembly of the roofing structure.

11. An assembly for a roofing structure as recited in claim 8 further comprising a plurality of securing devices structured and disposed to connect said upper layer to said lower layer.

12. An assembly for a roofing structure as recited in claim 11 wherein said securing devices are structured and disposed to penetrate said central member.

13. An assembly for a roofing structure as recited in claim 11 wherein said securing devices at least partially penetrate the framing assembly of the roofing structure.

14. A method of sheathing a roofing structure, comprising:

providing a lower layer disposed in at least partially overlying relation to the framing assembly of the roofing structure and forming said lower layer of a plurality of panels disposed in adjacent, substantially coplanar relation to one another, securing said plurality of panels of said lower layer to a framing assembly of the roofing structure in disconnected, spaced relation to next adjacent ones of said plurality of panels of said lower layer, disposing a central member comprising a plurality of sheets in overlying, confronting relation to said plurality of panels of said lower layer, disposing an upper layer comprising a plurality of spaced apart panels in overlying, confronting relation to said plurality of sheets of said central member, securing said plurality of panels of said upper layer to said plurality of panels of said lower layer securing said lower layer to at least one truss member of the framing assembly, and clamping said central member between said lower layer and said upper layer by disposing a bracket in clamping relation to said upper layer and the at least one truss member of the framing assembly.

15. A method of sheathing a roofing structure as recited in claim 14 further comprising at least initially disposing said plurality of panels of said lower layer into movable, disconnected, spaced relation to one another.

16. A method of sheathing a roofing structure as recited in claim 14 further comprising at least initially disposing said plurality of panels of said upper layer into movable, disconnected, spaced relation to one another.

17. A method of sheathing a roofing structure as recited in claim 14 forming said central layer from a plurality of sheets and disposing at least a portion of each of said plurality of sheets in substantially coplanar relation to one another thereby collectively defining a substantially flat configuration of said central member.

18. An assembly for a roofing structure as recited in claim 8 wherein said disconnected, spaced relation of said plurality of panels of said lower layer and said upper layer is further defined by said plurality of panels of respective ones of said lower and upper layers being movable relative to one another.

19. A method of sheathing a roofing structure, comprising:

providing a lower layer disposed in at least partially overlying relation to the framing assembly of the roofing structure and forming said lower layer of a plurality of panels disposed in adjacent, substantially coplanar relation to one another, at least initially disposing said plurality of panels of said lower layer into movable, disconnected, spaced relation to one another securing said plurality of panels of said lower layer to a framing assembly of the roofing structure in disconnected, spaced relation to next adjacent ones of said plurality of panels of said lower layer, disposing a central member comprising a plurality of sheets in overlying, confronting relation to said plurality of panels of said lower layer, disposing an upper layer comprising a plurality of spaced apart panels in overlying, confronting relation to said plurality of sheets of said central member, and securing said plurality of panels of said upper layer to said plurality of panels of said lower layer.

20. An assembly for a roofing structure, comprising:

at least one lower layer having a top surface and a bottom surface, wherein said lower layer comprises a plurality of laterally arranged panels disposed in disconnected, spaced relation to one another, said disconnected, spaced relation of said plurality of panels of said lower layer is at least partially defined by correspondingly disposed peripheries of adjacent ones of each of said plurality of panels of said lower layer being disposed in spaced relation to one another, said plurality of panels of said lower layer collectively disposed in overlying relation to a framing assembly of the roofing structure, at least one upper layer having a top surface and a bottom surface, wherein said upper layer comprises a plurality of laterally arranged panels disposed in disconnected, spaced relation to one another, said upper layer being disposable in an underlying relation to an outer roofing assembly of the roofing structure, a central member comprising a plurality of sheets disposed in confronting relation to and between said top surface of said lower layer and said bottom surface of said upper layer, and said plurality of sheets collectively and partially disposed in substantially coplanar relation to one another and in sandwiched relation between said plurality of panels of said lower layer and said plurality of panels of said upper layer.

21. An assembly for a roofing structure as recited in claim 20 wherein said disconnected, spaced relation of said plurality of panels of said upper layer is at least partially defined by correspondingly disposed peripheries of adjacent ones of each of said plurality of panels of said upper layer being disposed in spaced relation to one another.

22. An assembly for a roofing structure as recited in claim 21 wherein said disconnected, spaced relation of said plurality of panels of said lower layer and said upper layer is further defined by said plurality of panels of respective ones of said lower and upper layers being movable relative to one another.

* * * * *